United States Patent [19]

Keyaki

[11] Patent Number: 5,031,944

[45] Date of Patent: Jul. 16, 1991

[54] APPARATUS FOR BLOCKING RELEASE OF SLIDE FASTENER

[75] Inventor: Keiichi Keyaki, Toyama, Japan

[73] Assignee: Yoshida Kogyo K. K., Tokyo, Japan

[21] Appl. No.: 540,706

[22] Filed: Jun. 20, 1990

[30] Foreign Application Priority Data

Jun. 22, 1989 [JP] Japan ..... 1-73147[U]

[51] Int. Cl.[5] ..... B65D 33/34

[52] U.S. Cl. ..... 292/307 R; 70/68; 292/318; 24/387

[58] Field of Search ..... 292/307, 318–321; 24/381, 385, 433, 386, 387; 190/903, 119; 411/510

[56] References Cited

U.S. PATENT DOCUMENTS

| | | | |
|---|---|---|---|
| 2,569,706 | 9/1951 | Schaye | 24/387 |
| 2,578,035 | 12/1951 | Bashover | 24/387 |
| 2,621,387 | 12/1952 | Williams | 24/387 |
| 2,701,903 | 2/1955 | Williams | 24/387 |
| 3,955,842 | 5/1976 | Edwards | 292/307 R |
| 4,008,914 | 2/1977 | Anderson | 292/307 R |
| 4,027,361 | 6/1977 | Yoneya | 24/385 |
| 4,112,990 | 9/1978 | Anderson | 70/68 |
| 4,123,829 | 11/1978 | Takabatake | 24/386 |
| 4,588,218 | 5/1986 | Guiler et al. | 292/318 |
| 4,664,432 | 5/1987 | Swift | 292/307 |
| 4,697,833 | 10/1987 | Swift | 292/318 |

FOREIGN PATENT DOCUMENTS

| | | | |
|---|---|---|---|
| 425080 | 6/1948 | Italy | 411/510 |
| 67582 | 3/1944 | Norway | 24/387 |
| 8500152 | 1/1985 | PCT Int'l Appl. | 292/307 R |
| 204377 | 5/1966 | Sweden | 411/510 |

*Primary Examiner*—Gary L. Smith
*Assistant Examiner*—Darnell Boucher

[57] ABSTRACT

An apparatus for blocking the release of a slide fastener caused by the movement of a slider. According to the preferable embodiment, this apparatus comprises a pair of sliders, which are provided with a pair of ring-projections respectively, and a pair of engaging members as a blocking member for supporting and ensuring the interlocking of the ring-projections. Then, a pair of studs are provided at the engaging members respectively. When the sliders arranged reversely are moved forwardly to be contacted with each other for closing the slide fastener, the ring-projections are interlocked so that the eyes of the both ring-projections are overlapped. Next, each stud is pushed into the overlapped eyes from each side and engaged to another stud in the eyes so as not to be removed and not to be pulled out. Therefore, the release of the slide fastener caused by the movement of the slider is surely blocked. For allowing the release of the slide fastener, the base of either stud is cut and another side engaging member is pulled out. In so doing, the engaging members are disengaged from each other. Accordingly, the sliders can be moved backwardly away from each other for opening the slide fastener.

16 Claims, 3 Drawing Sheets

FIG. 1
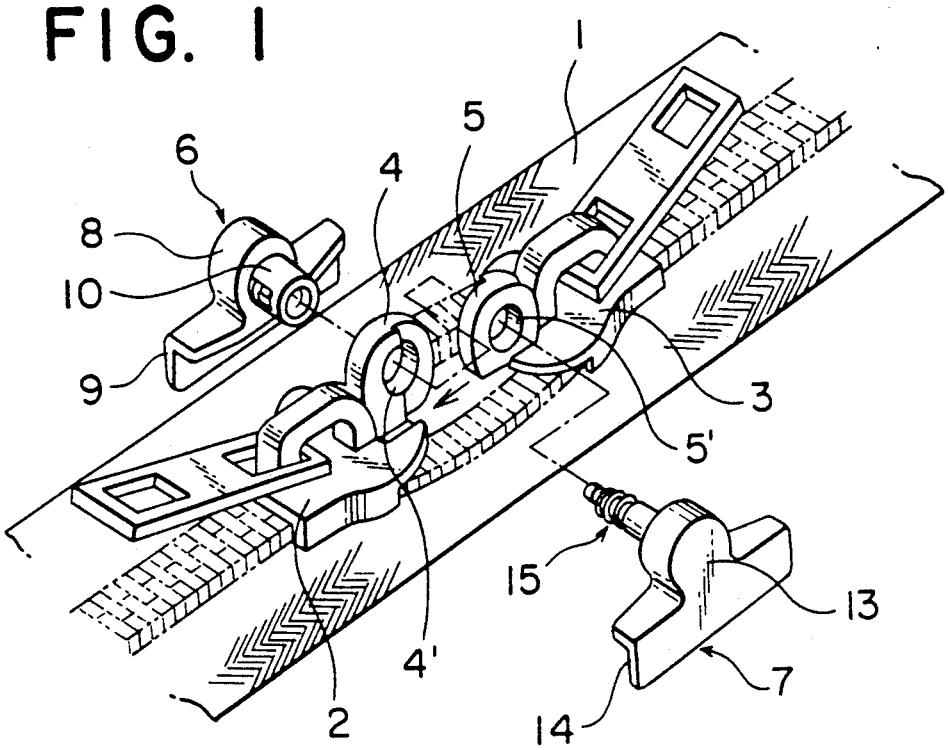
FIG. 2
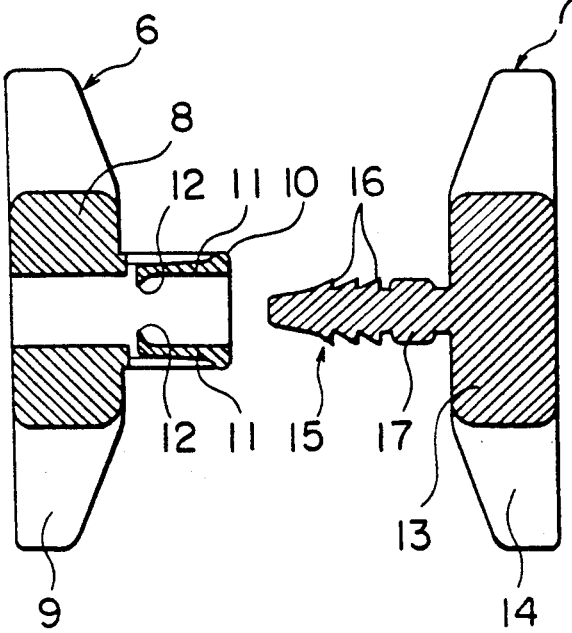
FIG. 3
FIG. 4
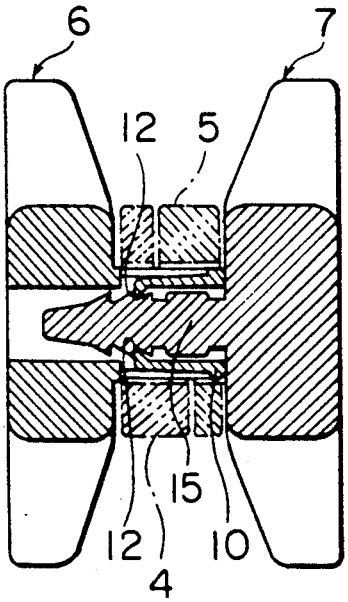

APPARATUS FOR BLOCKING RELEASE OF SLIDE FASTENER

BACKGROUND OF THE INVENTION

1. Field of the Invention

This invention relates to an apparatus for blocking the release of a slide fastener, which is used for closing and opening a baggage or the like, caused by the movement of a slider.

2Prior Art

In case that products are sent by a baggage or the like, closed and opened with a slide fastener, the baggage should be kept closed while it is carried. The slide fastener is opened and closed by the movement of a slider. Then, the release of the slide fastener is caused by the movement of the slider in a direction for opening the slide fastener. Accordingly, in order to keep the baggage closed, the movement of the slider should be blocked by a blocking member. Several kinds of blocking members are proposed such as a lock mechanism equipped to the baggage and a padlock used in a slide fastener related to Utility Model Publication No. 56-2071, or U.S. equivalent, U.S. Pat. No. 4,123,829. In this slide fastener, a pair of sliders are mounted on the rows of slide fastener elements. A pair of ring-projections are provided at the front end of the sliders respectively. When the sliders are moved forwardly to be contacted with each other for closing the slide fastener, the ring-projections are interlocked so that the eyes of the ring-projections are overlapped. Then, the padlock is inserted through the overlapped eyes for padlocking operation. As a result, the release of the slide fastener caused by the movement of the sliders is blocked under this operation. However, according to these conventional apparatuses, a duplicate key should be separately sent to the receiver. As an alternative means, a following apparatus can be used. Instead of the above padlock, one end of a wire is inserted through the overlapped eyes and sealed with another end by lead. However, in this case, since a sealed portion is exposed to be visible, the portion is broken easily on purpose. Further, since the portion is often caught by something, the sealing portion falls off and damages are caused to a slide fastener tape or the baggage.

SUMMARY OF THE INVENTION

It is therefore an object of the present invention to provide an apparatus which blocks easily and surely the release of a slide fastener caused by the movement of sliders and whose sealing portion is invisible so as not to be broken.

According to the present invention, the apparatus comprises a slider which is provided with a slider-ring-projection, an interlocked member which is provided with an interlocked member-ring-projection being set to be interlocked with the slider-ring-projection and a blocking member for supporting and ensuring the interlocking of the slider-ring-projection with the interlocked member-ring-projection. When the slider and the interlocked member are moved forwardly to be contacted with each other for closing the slide fastener, the ring-projections are interlocked so that the eyes of the ring-projections are overlapped. Then, a blocking member consists of a pair of engaging members provided with a pair of studs. One stud is pushed from each side into the overlapped eyes and is engaged to another stud in the overlapped eyes so as not to be removed and not to be pulled out. Therefore, the release of the slide fastener caused by the movement of the slider is surely blocked.

For allowing the release of the slide fastener, the base of either stud is cut at one side and an engaging member from another side is pulled out. In so doing, the engaging members are disengaged from each other. Therefore, the sliders can be moved backwardly to be apart from each other for opening the slide fastener.

Further objects and advantages of the present invention will be apparent from the following description, reference being had to the accompanying drawing wherein preferred embodiments of the present invention are clearly shown.

BRIEF DESCRIPTION OF THE DRAWINGS

FIG. 1 is a perspective exploded view of an apparatus of a first embodiment related to the present invention;

FIG. 2 is a sectional view of a female engaging member;

FIG. 3 is a sectional view of a male engaging member;

FIG. 4 is a sectional view showing a pair of engaging members which are engaged to each other;

DESCRIPTION OF THE PREFERRED EMBODIMENT

Figure 5:
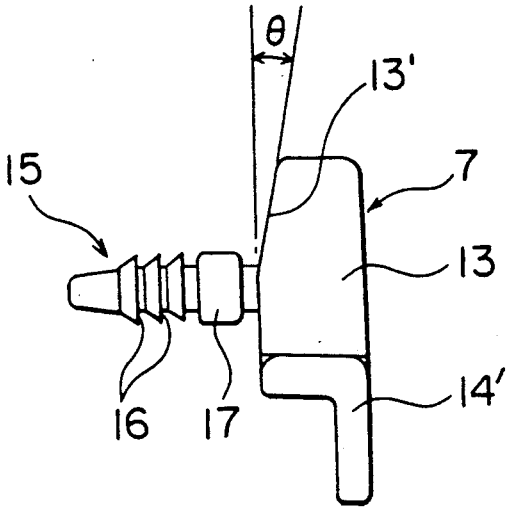
FIG. 5 is a side view of a male engaging member.

Now, the present invention is described more particularly.

In the first embodiment shown in FIG. 1, a slide fastener 1 comprises a pair of sliders 2, 3, a pair of fastener tapes, two rows of coupling fastener elements being secured to the fastener tapes respectively. The sliders 2, 3 arranged reversely are slidably mounted on the two rows of the fastener elements. Each front end of the slider 2, 3 is provided with a ring-projection 4, 5 having an eye 4', 5' respectively. In this embodiment, the front half of each ring-projection 4, 5 is made less in thickness than its rear half in order to provide offset shoulder portions which abut each other. Then, when the sliders 2, 3 are moved forwardly from opposite directions to be contacted with each other for closing slide fastener 1, both ring-projections 4, 5 can be interlocked to each other so that the eyes 4', 5' are overlapped. For blocking the release of the slide fastener 1 caused by the movement of the sliders 2, 3, a pair of female and male engaging members 6, 7 are engaged in the overlapped eyes 4', 5'. As shown in FIGS. 1, 2, the female engaging member 6 molded with a synthetic resin material comprises a flange 8, a cover portion 9 and a stud 10. The flange 8 covers the external side of the ring-projection 4. The cover portion 9 is provided so as to be below the flange 8 integrally and extended in the direction of the slide fastener 1 toward both sides from the flange 8. When the sliders 2, 3 are moved forwardly to be contacted with each other from opposite directions, the flange 8 and cover portion 9 can cover external sides of the both sliders 2, 3 including the unclosed portion of a row of slide fastener elements between both sliders 2, 3. The cylindrical shaped stud 10 is projected from the center of the flange 8 laterally in relation to the direction of the slide fastener 1 so as to be pushed into the eyes 4', 5' when the ring-projections 4, 5 are interlocked. At least a pair of resilient tongues 11, 11 are attached along the internal surface of the stud 10. Then, each back end of each resilient tongue 11, 11 is unattached to its internal side surface to be a claw 12. The claws 12, 12 are standing from the resilient tongues 11, 11 respectively to face each other in the stud 10. The flange 8 has a window with communication of the interior of the stud 10 due to its producing method of being molded with the synthetic resin material.

As shown in FIGS. 1, 3, the male engaging member 7, which is molded with a synthetic resin material, comprises a flange 13, a cover portion 14 and a stud 15. The flange 13 covers the external side of the ring-projection 5. The cover portion 14 is provided below the flange 13 integrally. The structure of the male engaging member 7 is similar to that of the female engaging member 6 with an exception that the rod shaped stud 15 is projected from the center of the flange 13 to be pushed into the hole of the cylindrical shaped female stud 10. A plurality of circumferential engaged grooves 16 are formed on the external circumference of the stud 15 so that jagged upper and lower lines are formed on the stud 15 on its cross section. A swollen portion 17 is formed at the base of the stud 15 a short distance from the flange 13 so as to plug the hole of the female stud 10 when the stud 15 is inserted into the hole. Further, as shown in FIG. 5, the stud-side surface of the flange 13 is slanted away from the stud 15 from its root to the upper end of the flange 13 with an angle Θ to be a slanted surface 13'. The slanted surface can be formed on the stud-side surface of the female flange 8. However, it is enough that the slanted surface is provided on the male flange 13 or the female flange 8. In each groove 16, a tapered surface from the base-side to the fore end-side of the stud 15 is formed. The number of the grooves 16 might be one. However, a plurality of grooves 16 are preferred to be provided. The reason for this is as follows. As described hereinbefore, the female flange 8 has the window, which is communicated interior of the female stud 10. If only one groove 16 is provided, the claws 12, 12 are seen to be engaged to the groove 16 from the window, which is insecure. Therefore, it is preferred that a plurality of grooves 16 are formed and that the claws 12, 12 are engaged to one groove 16, which is the second groove 16 from the fore end of the male stud 15. In so doing, it is invisible that the claws 12 are engaged to the groove 16. However, when the female engaging member 6 which has no window can be formed, even if only one groove 16 is provided, it is invisible that the claws 12 are engaged to the groove 16.

Now, operation in this embodiment will be described.

In order that the release of the slide fastener 1 caused by the movement of the sliders 2, 3 is blocked by the female and male engaging members 6, 7, the following operation is carried out. When the sliders 2, 3 arranged reversely are moved forwardly to be contacted with each other for closing the slide fastener 1, the ring-projections 4, 5 are interlocked so that the eyes 4' 5' are overlapped. Then, the female stud 10 is pushed into the overlapped eyes 4', 5' from a female side until the female flange 8 stops at the ring-projection 4. Next, the male stud 15 is pushed into the female stud 10 until the male flange 13 stops at the ring-projection 5. In so doing, the claws 12, 12 of the female stud 10 are engaged to the groove 16 of the male stud 15. Accordingly, the male and female engaging members 6, 7 are engaged integrally so as not to be removed and not to be pulled out. Therefore, the slide fastener 1 is closed and the release of the slide fastener 1 caused by the movement of the slider 2, 3 is blocked. Since the swollen portion 17 plugs the hole of the female stud 10 so that the engagement of the claw 12 to the groove 16 is ensured, the engagement of both engaging members 6, 7 is further ensured.

The slide fastener 1, whose release caused by the movement of the slider 2, 3 has been blocked by above mentioned operation, is allowed to slide as follows. Due to the slanted surface 13' of the male flange 13, a small space is formed at the root of the male stud 15. Accordingly, it is easy to cut away the base of the male stud 15 with a cutter such as a sheather, a small knife and the like which is inserted in the space. In so doing, the male flange 13 is removed while the most of the male stud 15 is left as it is engaged to the female stud 10. However, when the female engaging member 6 is pulled out, the engaging member 6, 7 is totally disengaged from each other. Therefore, the sliders 2, 3 can be moved backwardly to be apart from each other for opening the slide fastener 1.

Each cover portion 9, 14 of each engaging member 6, 7 is provided for covering each external side of the unclosed portion of each row of the slide fastener elements. Therefore, the slide fastener 1 is not opened at the portion against a force which would pull each row of the slide fastener elements laterally and externally in relation to the direction of the slide fastener 1.

Figure 6:
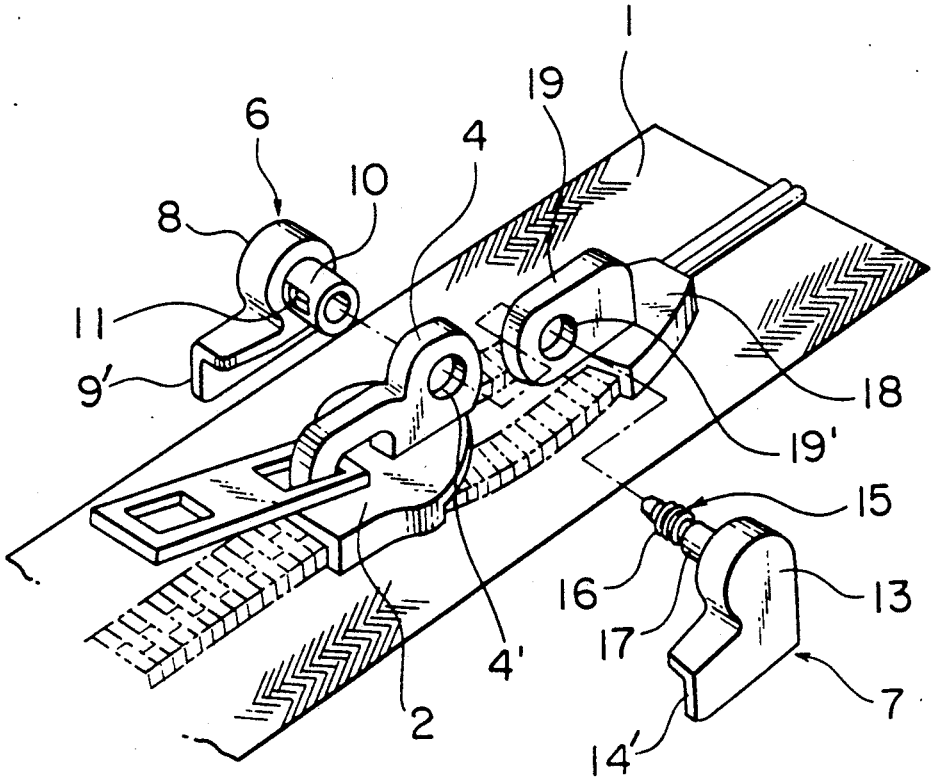
FIG. 6 is a perspective exploded view of an apparatus of the second embodiment related to the present invention.

Second embodiment of the present invention is shown in FIG. 6 The structure of a slide fastener 1 related to the second embodiment is similar to that of the slide fastener 1 related to the first embodiment with an exception that an end stop 18 is used in the second embodiment instead of the slider 3 of the first embodiment. The slide fastener 1 is provided with a slider 2 and the end stop 18, which is mounted on the two rows of slide fastener elements and which is fixed at the end of the elements. Each front end of the slider 2 and the end stop 18 is provided with a slider-ring-projection 4 with an eye 4' and an end stop-ring-projection 19 with an eye 19' respectively. When the slider 2 is moved forwardly to be contacted with end stop 18, both ring-projections 4, 19 are interlocked to each other so that the eyes 4', 19' are overlapped. For blocking the release of the slide fastener 1 caused by the movement of the slider 2, a pair of female and male engaging members 6, 7 are engaged by the engagement of studs 10, 15 in the overlapped eyes 4', 19'.

The female and male engaging members 6, 7 have a similar structure to the above mentioned engaging members 6, 7 of the first embodiment. That is to say, in an apparatus of the second embodiment, the female engaging member 6 is also provided with a flange 8, a cover portion 9', a cylindrical shaped stud 10, resilient tongues 11 and claws (not shown). Then, the male engaging member 7 of this apparatus is also provided with a flange 13, a cover portion 14', the rod shaped stud 15, circumferential engaged grooves 16 and a swollen portion 17. Since this second embodiment is applied for combination of the slider 2 and the end stop 18, each cover portion 9', 14' is provided so as to be below each flange 8, 13 integrally and extended in the direction of the slide fastener 1 to only a slider-side from the flange 8, 13 for covering an unclosed portion of each row of slide fastener elements.

Figure 7:
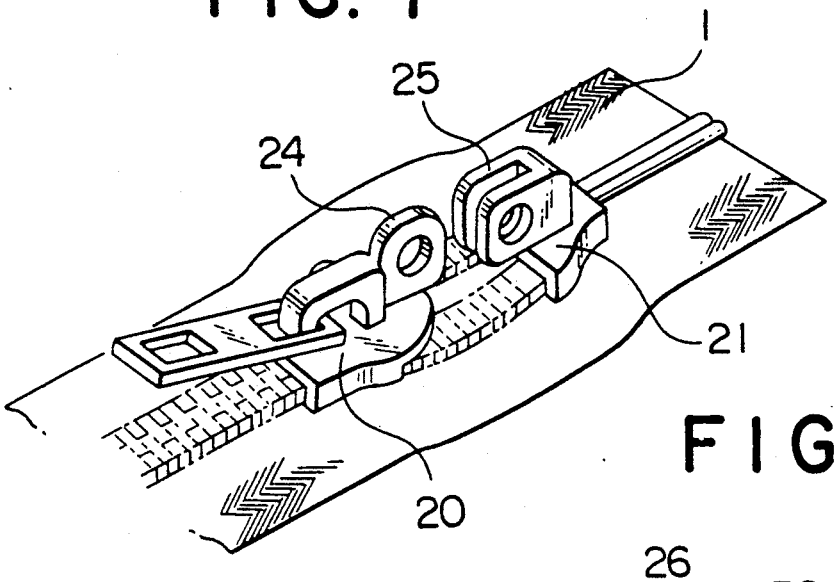
FIG. 7 is a perspective view showing a modified embodiment of the ring-projections.

A pair of a slider-ring-projection 24 and an end stop-ring-projection 25 shown in FIG. 7 are a modified embodiment of the pair of slider-ring-projection 4 and the end stop-ring-projection 19 shown in FIG. 6. Each front end of the slider 20 and the end stop 21 is provided with a slider-ring-projection with an eye 24' and an end stop-ring-projection 25 with an eye respectively. The end stop-ring-projection 25 consists of two parallel projections while the slider-ring-projection 24 consists of one projection. When the slider 20 is moved forwardly to be contacted with the end stop 21, the one projection of the slider-ring projection 24 is fitted between the two parallel projections of the end stop-ring-projection 25. Accordingly, both ring-projections 24, 25 can be interlocked to each other so that their eyes are overlapped, where the studs 10, 15 (FIGS. 1, 6) engage each other. Finally, the release of the slide fastener 1 caused by the movement of the slider 20 is blocked. Although the ring-projection 24 with the one projection is provided at the slider 20 in FIG. 7, it also can be provided at the end stop 21 while the ring-projection 25 with the two projections is provided at the slider 20.

Figure 8:
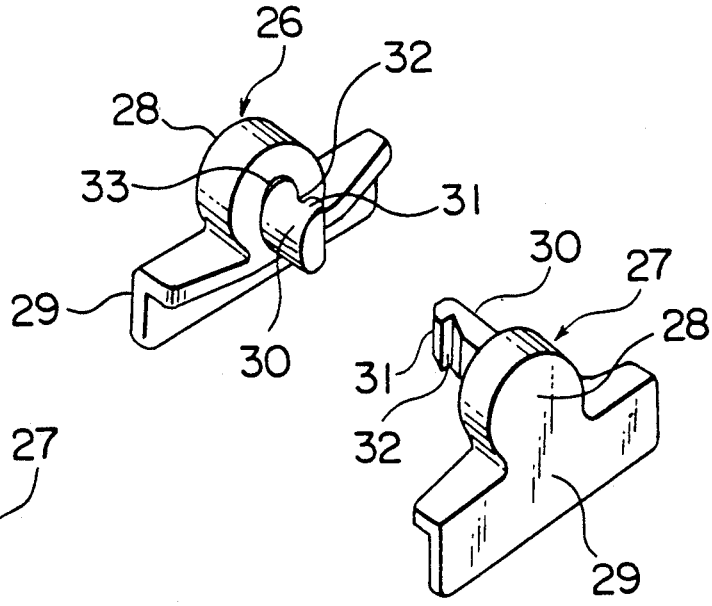
FIG. 8 is a perspective view showing another embodiment of the engaging members.
Figure 9:
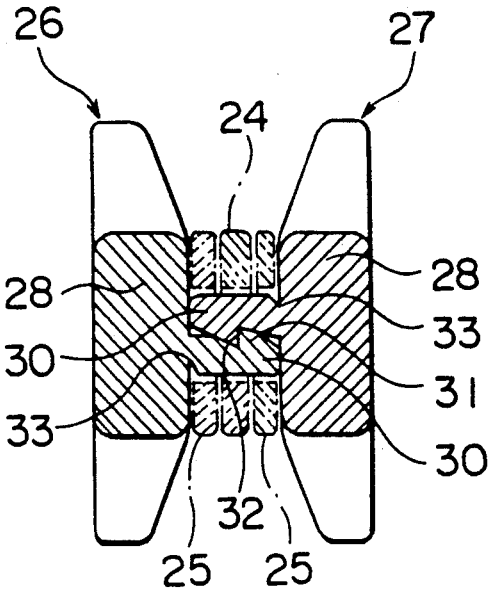
FIG. 9 is a sectional view showing the embodiment of FIG. 8 where the engaging members are engaged.

Another embodiment of the pair of engaging members 6, 7 is shown in FIGS. 8, 9. Both engaging members 26, 27 of this embodiment have a same structure and designed so as to engage each other for blocking the release of the slide fastener 1 (FIGS. 1, 6, 7) caused by the movement of the slider 2, 3, 20 (FIGS. 1, 6, 7). Although in FIG. 9, the pair of engaging members 26, 27 are applied to a combination of the ring-projections 24, 25, they can be also applied to other combinations of ring-projections 4, 5 (FIG. 1) and 4, 19 (FIG. 6). A pair of studs 30, 30 differ from the above mentioned pairs of studs 10, 15 (FIGS. 1, 2, 3, 4, 5 and 6) in that they have a same structure with the symmetrical arrangement of engaging portions 31, 31 and engaged notches 32, 32. The engaging portions 31, 31 are located at the fore end of the studs 30, 30 respectively and the engaged notches 32, 32 are located right behind the engaging portions 31, 31 respectively. Then, a groove 33 is formed at the root of either stud 30, 30 in which a cutter is inserted for easy cutting of the base of this stud 30, 30. Although in FIG. 8, cover portions 29, 29 are provided so as to be below flanges 28, 28 respectively and extended in the direction of the slide fastener 1 toward both sides of flanges 28, 28 respectively, they can be extended in the direction toward either side of the flange 28, 28 in the same manner as the above mentioned cover portions 9', 14' (FIG. 6).

Operation of this embodiment is as follows. The studs 30, 30 are pushed into the eyes 4', 5' (FIG. 1) or 4', 19' (FIG. 6). In so doing, each engaging portion 31, 31 of each stud 30, 30 engages to each engaged notch 32, 32 of the opposite stud 30, 30 due to their symmetrical arrangement. Therefore, both engaging members 26, 27 are engaged to each other so as not to be removed and not to be pulled out. As a result, the release of the slide fastener 1 caused by the movement of the slider 2, 3, 20 (FIGS. 1, 6, 7) is blocked.

For allowing the release of the slide fastener 1 caused by the movement of the slider 2, 3, 20 in the above embodiments (FIGS. 6, 7, 8, 9), the method of the first embodiment can be used. That is to say, the base of either stud 10, 15, 30 is cut at one side and an engaging member 6, 7, 26, 27 is pulled out from another side. In so doing, the engaging members 6, 7, 26, 27 are disengaged from each other. Therefore, the slider 2, 3, 20 can be moved backwardly away from another slider 2, 3 or the end stop 18, 21 for opening the slide fastener 1.

While preferred embodiments have been described, it is apparent that the present invention is not limited to the specific embodiments thereof.

What is claimed is:

1. An apparatus for blocking the release of a slide fastener caused by the movement of a slider mounted upon two rows of fastener elements, said apparatus comprising:

said slider which is provided with a slider-ring-projection having an eye;

an interlocked member which is provided with an interlocked member-ring-projection having one eye and being set to be interlocked with said slider-ring-projection; and a blocking member which supports and ensures the interlocking of said slider-ring-projection with said interlocked member-ring-projection and which comprises a pair of engaging members each provided with a flange, a stud projected from each of said flanges, and a cover portion formed below each of said flanges, wherein said studs are pushed from both sides respectively into the eyes of said member and slider ring-projections said studs being interlocked and engaged to each other in said eyes so as not to be removed and not to be pulled out.

2. An apparatus for blocking the release of a slide fastener caused by the movement of a slider according to claim 1, wherein said interlocked member is another slider which is disposed in position to face said slider.

3. An apparatus for blocking the release of a slide fastener caused by the movement of a slider according to claim 1, wherein said interlocked member is an end stop mounted on the rows of slide fastener elements.

4. An apparatus for blocking the release of a slide fastener caused by the movement of a slider according to claim 1, wherein said cover portions are arranged to cover external sides of unclosed portions of the two rows of slide fastener elements between said slider and said interlocked member.

5. An apparatus for blocking the release of a slide fastener caused by the movement of a slider according to claim 1, wherein said engaging members are made of synthetic resin.

6. An apparatus for blocking the release of a slide fastener caused by the movement of a slider according to claim 1, wherein a stud-side surface of said flange is slanted away from said stud from its root to said upper end of said flange with a predetermined angle.

7. An apparatus for blocking the release of a slide fastener caused by the movement of a slider mounted upon two rows of fastener elements arranged on a surface, said apparatus comprising:

said slider which is provided with a first projecting member having a first aperture therein;

a second member arranged facing said slider, provided with a second projecting member having a second aperture therethrough, said second projecting member arranged for said first projecting member to align therewith, with said first aperture open to said second aperture;

a blocking member which supports and insures the coupling of said first projecting member with said second projecting member, and which comprises a pair of engaging members each provided with a flange, a stud projected from each of said flanges, and a cover portion formed below each of said flanges, wherein said studs are inserted through said first aperture and said second aperture in a direction toward each respective other stud from opposite sides of said first and second projection members respectively, said studs engaging each other so as not to be removed without damage when a prying apart force is applied along an axis of said studs.

8. An apparatus for blocking the release of a slide fastener caused by the movement of a slider according to claim 7, wherein said first projecting member and said second projecting member are aligned to overlap upon approach of said slider to said second member, with said first aperture and said second aperture coaxially aligning.

9. An apparatus for blocking the release of a slide fastener caused by the movement of a slider according to claim 8, wherein said first projecting member and said second projecting member each provide offset shoulder portions which abut when said first aperture and second aperture are aligned coaxially.

10. An apparatus for blocking the release of a slide fastener caused by the movement of a slider according to claim 8, wherein said cover portions are arranged to cover external sides of unclosed portions of two rows of slide fastener elements located between said slider and said second member.

11. An apparatus for blocking the release of a slide fastener caused by the movement of a slider according to claim 10, wherein said cover portions comprise a L-shaped cross section having side walls extending in perpendicular fashion to said surface and a top wall portion elevated from said surface and arranged in parallel planar fashion with said surface.

12. An apparatus for blocking the release of a slide fastener caused by the movement of a slider according to claim 11, wherein said second member is another slider which is disposed in position to face said slider.

13. An apparatus for blocking the release of a slide fastener caused by the movement of a slider according to claim 11, wherein said second member is an end stop mounted on the two rows of slide fastener elements.

14. An apparatus for blocking the release of a slide fastener caused by the movement of a slider according to claim 10, wherein said studs comprise a female stud and a male stud, said male stud providing a plurality of grooves 16, and said female stud provides an axial channel for receiving the male stud and at least one claw residing therein, insertion of the male stud into said axial channel causes said claw to resiliently engage into a groove to interlock said male stud into said female stud.

15. An apparatus for blocking the release of a slide fastener caused by the movement of a slider according to claim 10, wherein said studs provide on each stud a hook having engaging portions at distal ends of said studs and notches formed adjacent to said engaging portions toward a root of each said stud, each engaging portion interlockable into an engaging notch formed in the respective other stud when said studs are engaged through said first and said second apertures.

16. An apparatus for blocking the release of a slide fastener caused by the movement of a slider according to claim 15, wherein said engaging members are substantially identically configured pieces.

* * * * *